US006568007B1

(12) United States Patent
Hatcher

(10) Patent No.: US 6,568,007 B1
(45) Date of Patent: May 27, 2003

(54) SLITTED BLANKET ADAPTED TO ACCOMODATE FEET

(76) Inventor: Louise Hatcher, 2093 Rebecca St., Simi Valley, CA (US) 93063

( * ) Notice: Subject to any disclaimer, the term of this patent is extended or adjusted under 35 U.S.C. 154(b) by 0 days.

(21) Appl. No.: 10/022,062

(22) Filed: Dec. 17, 2001

(51) Int. Cl.[7] ..... A47G 9/02
(52) U.S. Cl. ..... 5/482; 5/502; 112/475.08
(58) Field of Search ..... 5/482, 485, 502, 5/486, 495; 112/475.08

(56) References Cited

U.S. PATENT DOCUMENTS 2,722,694 A * 11/1955 Bryant
3,638,251 A * 2/1972 Weiss ..... 5/482
4,062,076 A * 12/1977 Albertson ..... 5/482
5,245,717 A * 9/1993 Rudy ..... 5/485

* cited by examiner

*Primary Examiner*—Alexander Grosz
(74) *Attorney, Agent, or Firm*—Maria Erlinda Co Sarno

(57) ABSTRACT

This invention relates to a blanket having a slit through which a person's feet may protrude. The blanket is designed for singles, couples or multiple persons sharing a blanket. The individuals sharing the same blanket can protrude their feet or keep them inside the blanket. The slit is not just a plain opening or cut across the top surface of the blanket but rather, the slit is designed to form an opening that looks like a pocket with an open or unsewn bottom.

15 Claims, 5 Drawing Sheets

SLITTED BLANKET ADAPTED TO ACCOMODATE FEET

This invention relates to a blanket having a slit through which a person's feet may protrude. The blanket is designed for singles, couples or multiple persons sharing a blanket. The individuals sharing the same blanket can protrude their feet or keep them inside the blanket.

BACKGROUND

All commercial blankets today come as a whole sheet. Some individuals, however, want to expose their feet when sleeping especially during summer while keeping their bodies covered. For these individuals, the only option is to pull the blanket upwards to expose their feet. While this is a solution, because of the size of the standard blankets, it is still a struggle to keep the feet exposed at all times. Further, the problem is accentuated when two or more individuals with different preferences are sharing the same blanket. It would be difficult for one to keep his or her feet in the blanket while the other individual keeps his or her feet exposed. The blanket of this invention addresses this problem.

It is an object of this invention to provide a blanket that will keep an individual's feet out of the blanket but keeps his or her body covered.

It is also an object of this invention to provide a blanket that will cater to one's preference of keeping his or her feet out while the other individual/s sharing the same blanket keep their feet inside.

SUMMARY OF THE INVENTION

This is related to a blanket having a slit for exposing a foot while keeping the other parts of the body covered. The blanket is made of a fabric material having a top surface, a bottom surface with the peripheral edges preferably protected from frilling. The core of the invention is the slit forming an opening resembling an open bottom pocket located across the top surface of the fabric. This slit is formed by overlapping pieces of fabric materials. The overlap of the pieces of fabric material is preferably 12 to 15 inches in length to keep the exposed feet uncovered while sleeping but at the same time keep the covered feet covered. This amount of overlap will also prevent air from drafting into the blanket. The width of the slit is preferably the same as that of a mattress sized for the blanket. For example, for a twin size blanket the width of the slit will be the same as the width of a twin mattress. The width can be narrower than the width of the mattress, however, it should not be less than 15 inches. A narrower slit would not comfortably accommodate an individual's feet unless it is desired to custom make the blanket so that only one foot has to be exposed while keeping the other foot covered. In the latter case, the slit may be narrower than 15 inches. The blanket may be made from one layer or multilayer of fabric materials and may have different geometric shapes aside from four sided such as rectangular or square.

There are generally two ways of assembling the slitted blanket from a piece or pieces of fabric materials. One way is to cut pieces of fabric materials, usually at least two, to a desired dimension; overlapping the pieces of fabric material that would serve to cover the body; and, sewing these overlapping pieces of fabric material together at each lateral side of the overlap to form an open bottom pocketlike opening. If the area of the pieces of fabric material joined together is not large enough, matching pieces of fabric material may be sewn on each lateral side of the main pieces of fabric material to widen the blanket. If the width of the slit or opening is too wide, one may narrow this by sewing together, horizontally along the slit, a portion of the overlapping fabric materials to a desired dimension. The peripheral edges are preferably protected from frilling by methods known in the art such as trimming, hemming, overlocking and overlapping a strip of fabric on the exposed edges.

The other way of assembling the slitted blanket is by cutting a piece of fabric material conforming to a desired size and shape of the blanket; cutting a slit of a desired width across a desired position on the piece of fabric material thereby forming a top slit and a bottom slit; and, sewing a piece of fabric material having a length of at least 12 inches and a width matching the width of the slit to the bottom slit to form an opening resembling an open bottom pocket. The preferable ranges of the width of the opening and the length of the overlap is as described above. Also as above, it is preferable to protect any exposed edges of the blanket from frilling.

DESCRIPTION OF THE INVENTION

Figure 1:
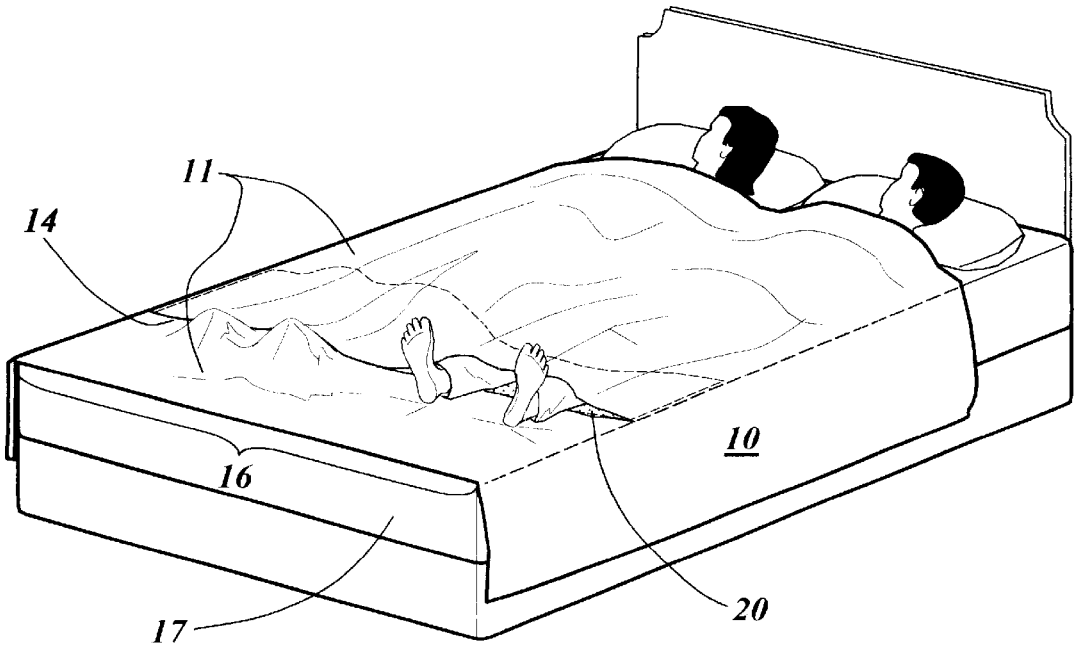
FIG. 1 is a perspective view of the blanket as it is used.
Figure 2:
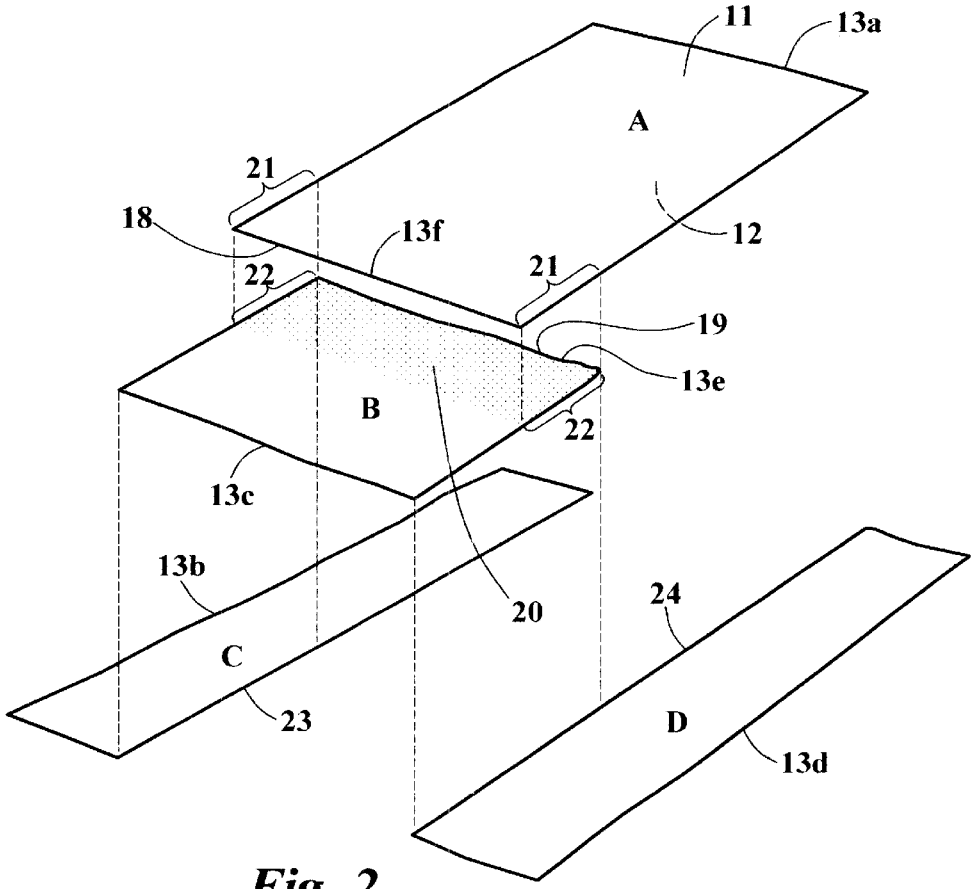
FIG. 2 is an exploded view of how the pieces are sewn together to form the blanket with a slit with an overlapping section shaded for illustration purpose.

FIGS. 1 and 2 show the blanket with a slit 10, hereinafter referred to plainly as blanket, as it is used by a couple, one preferring to put her feet under the blanket while the other preferring to keep his feet uncovered. The blanket 10 as shown here is generally rectangular in shape having a top surface 11, a bottom surface 12, and borders 13*a–f*. Other shapes are known and used. The peripheral edges or borders 13*a–f* of the blanket 10 are preferably protected from frilling off, that is, threads being unwoven and detaching from the fabric, by means known in the art such as trimming with pinking shears or edging scissors, hemming, overlooking or by overlapping a strip of fabric along the peripheral edges or borders of the fabric.

The blanket may be made of one layer or a multilayer of fabric material. The fabric material suitable for making a blanket is known and is dependent on the weather condition, for example, a thin sheet of cotton is preferable for warm weather while wool and quilted multilayer of fabric are preferable for the cold weather. The kind of fabric may be natural, man-made, synthetic or blended. The blanket may be plain or with design.

Figure 2A:
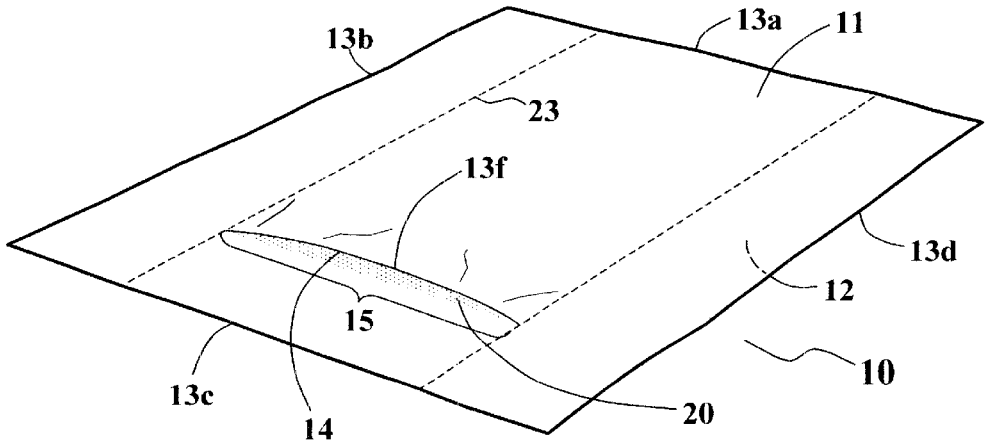
FIG. 2A shows the bottom overlap as a shaded area underneath the top surface of a finished blanket.

The slit 14 of the blanket runs horizontally across the top surface 11 of the blanket, preferably, with the width 15 of the slit the same as the width 16 of the mattress 17 as shown in FIG. 1 and 2A. For example, for a twin size blanket, the width 15 of the slit 14 will be approximately 39 inches since this is the usual width of a twin size mattress. For a full size, it is approximately 54 inches, for a queen size, 60 inches and for a king or California king, 72–76 inches. The recommended minimum width of the slit is 15 inches because this would comfortably accommodate only one person's feet protruding from the slit. The important feature of this invention is the design of the slit 14. The slit is not just a plain opening cut across the top surface of the blanket but rather, the slit is designed to form an opening that looks like a pocket with an open or unsewn bottom. To more clearly describe the slit 14, it is further identified as having a top 18 lip and bottom lip 19. The top lip 18 does not align with the bottom lip 19 but has corresponding overlapping sections as shown in FIGS. 1, 2A, 3, 3A, 5 and 5A. The bottom section extending outwards from lip 19 is hereinafter referred to as bottom overlap 20 and this section is shaded to assist in describing the slit. The bottom overlap 20 ranges from 12 to 15 inches in length with a width matching the width of the slit which is preferably the same as the width of the mattress. FIG. 1 shows the location of the overlapping section on the blanket with dash lines with the bottom overlap 20 shaded to differentiate this from the corresponding overlapping section at the top surface of the blanket. Note that the bottom overlap 20 is underneath the feet of the individual who wants his/her feet exposed while the individual who wants his/her feet covered has these underneath or covered by the bottom overlap 20, that is, the feet are fully covered under both the top and bottom 20 overlapping sections. An overlapping section that has a length of 12–15 inches allows the exposed feet to be exposed all the time while keeping the covered feet, fully covered. With this amount of overlap, the exposed feet laying over the bottom overlap 20 will be kept exposed because it will be not be so easy, although not impossible, to go under the overlap. The covered feet, on the other hand, will be kept covered because the weight of the exposed feet keeps the bottom overlap 20 in place. The length of the overlap is preferably not less than 12 inches because a shorter length will allow the air to draft into the blanket 10, thereby causing discomfort for the person who wants his/her feet covered. Note that one can also use this blanket with a little bit of adjustment for keeping one foot exposed while keeping another foot covered.

Figure 4:
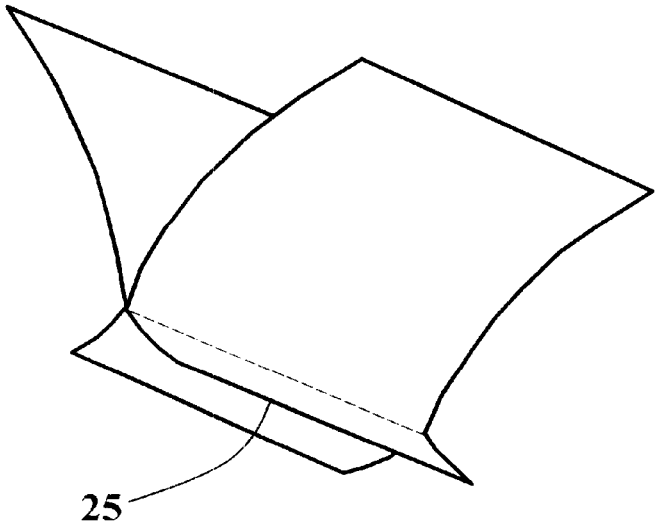
FIG. 4 shows how the pieces are sewn together underneath.
Figure 4A:
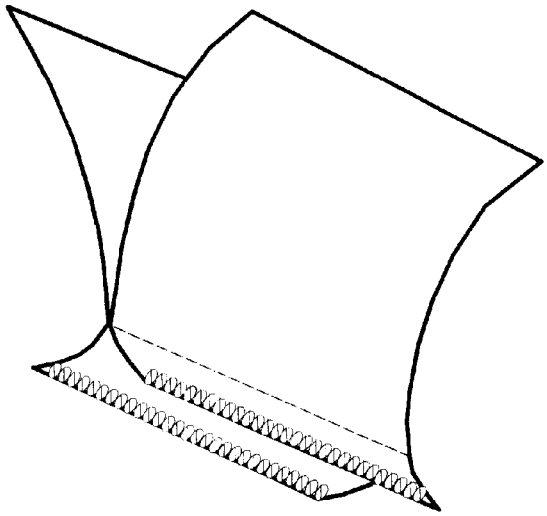
FIG. 4A shows overlooking on the edges or borders.

FIG. 2 shows one easy way to assemble or make the blanket 10. Four pieces of fabric, A–D, are cut and sewn together. To form the slitted top surface 11, a proximal end section 21 of A and a distal section 22 of B are sewn together on both lateral sides to form the open pocketlike slit wherein the top lip 18 would be on the top surface and exposed while the bottom lip 19 would be inside and underneath the top surface. The distal section 22, shaded for illustration, forms the bottom overlap 20 underneath the top surface 11, therefore the length of this section should be 12–15 inches. The top lip 18 is bordered by 13*f* while the bottom lip 19 is bordered by 13*e*. The inside lateral side 23 of piece C is then sewn with an inside lateral side of A and the opposite inside lateral side of A is sewn with the inside lateral side 24 of piece D in a manner shown in FIG. 4. The inside lateral sides of A are formed after end sections 21 and 22 are sewn together. The interconnection of the pieces of fabric in the methods described herein are done in the same manner as shown in FIG. 4. After sewing the pieces together, the edges 25 are preferably overlooked to prevent frilling as shown in FIG. 4A. Other means to prevent frilling as described above can also be used. In use, pieces C and D would normally overlay and hang along the lateral sides of the bed depending upon its widths. The width of pieces C and D are normally obtained by subtracting the standard width of the mattress from the standard width of the blanket. For example, in a twin size blanket having a width of 65 inches, the preferred size or width of the slit of 39 inches is subtracted from 65 to give a difference of 26 inches. Therefore, the width of C would be 13 inches and the width of D would be 13 inches. The length of pieces C and D would normally be the same as the length of a standard twin which is approximately 90 inches. This holds true for the other sizes such as full, queen and king, as well. The widths of the blankets are typically 62–66 inches for twin, 72–80 inches for full, 90–92 for queen and king while the widths of the mattresses are typically 39 inches for twin, 54 inches for full, 60 inches for queen, 76 inches for king and 72 inches for California king. The above method of attaching or connecting pieces like C and D on both sides of another piece like piece A shown here, as well as protecting the edges or borders from frilling are also applicable to all similar steps that will be described hereafter, therefore, these methods will not be repeatedly described in detail. FIG. 2A shows the finished blanket 10 with the bottom overlap 20 shaded to illustrate the pocket-like opening.

Figure 3:
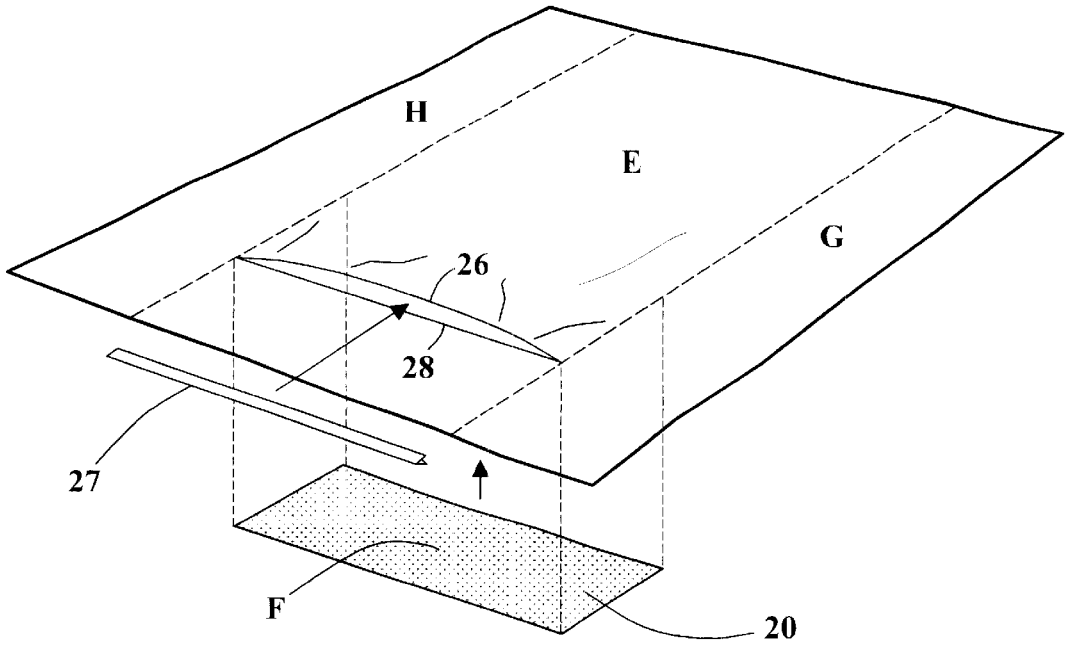
FIG. 3 is an exploded view of another method of forming the slit with an overlap on a blanket.
Figure 3A:
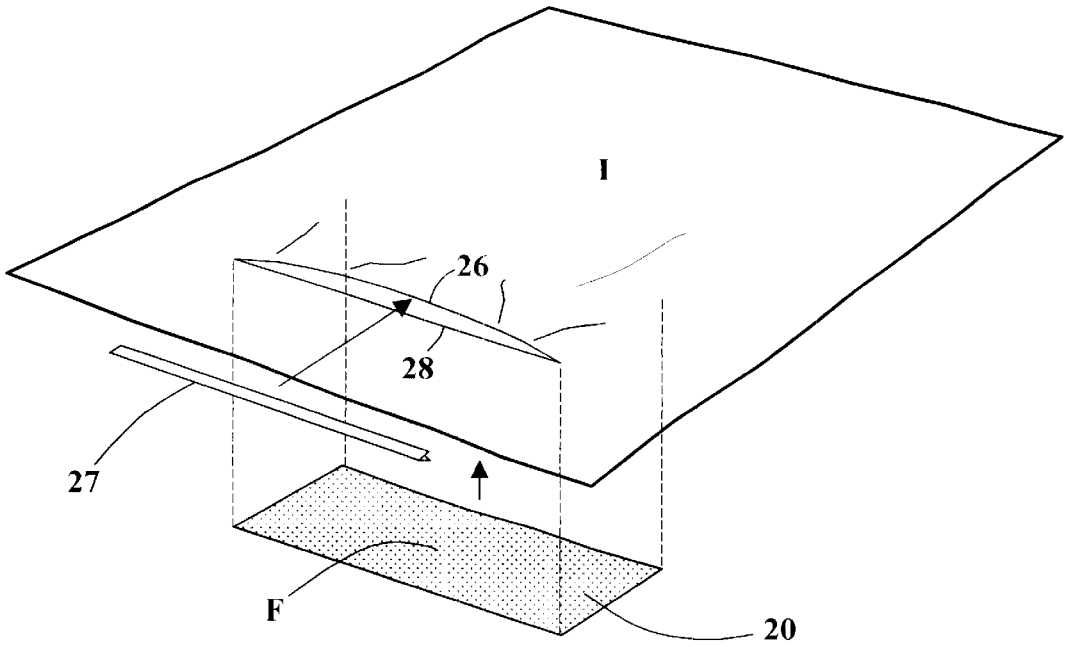
FIG. 3A is an exploded view of another method of making the slitted blanket from a one piece starting material.

Another method of assembling the blanket 10 as shown in FIG. 3 is to simply cut a slit on piece E, protect the resulting top lip 26 from frilling by methods known in the art, typically by overlapping a strip of fabric 27 on top lip 26 and sewing a piece F to the bottom lip 28, the piece F having the dimensions of the bottom overlap 20 as described above. Pieces G and H are sewn on each lateral side of E in the same manner as pieces C and D are sewn to the lateral sides of A. This same method can be applied to a one piece starting material I as shown in FIG. 3A. Here, there are no separate pieces like G and H to be sewn to E as shown in FIG. 3. Rather, after the slit is cut on I, the same methods as described above for protecting the edges of the slit from frilling and for sewing the bottom overlap 20 to the resulting bottom lip 28 are followed. This latter method would work well for blankets that are not four sided but are of different geometric shapes such as circle, oval, and the like.

Figure 5:
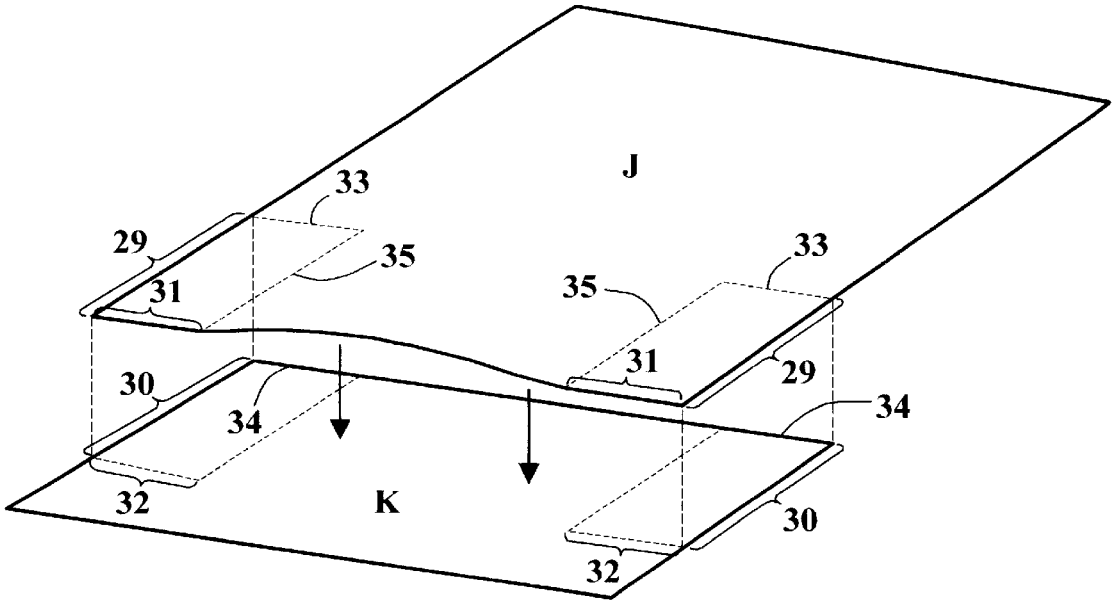
FIG. 5 is an exploded view of assembling a slitted, blanket from two pieces of fabric sewn on the sides to limit the length of the slit.
Figure 5A:
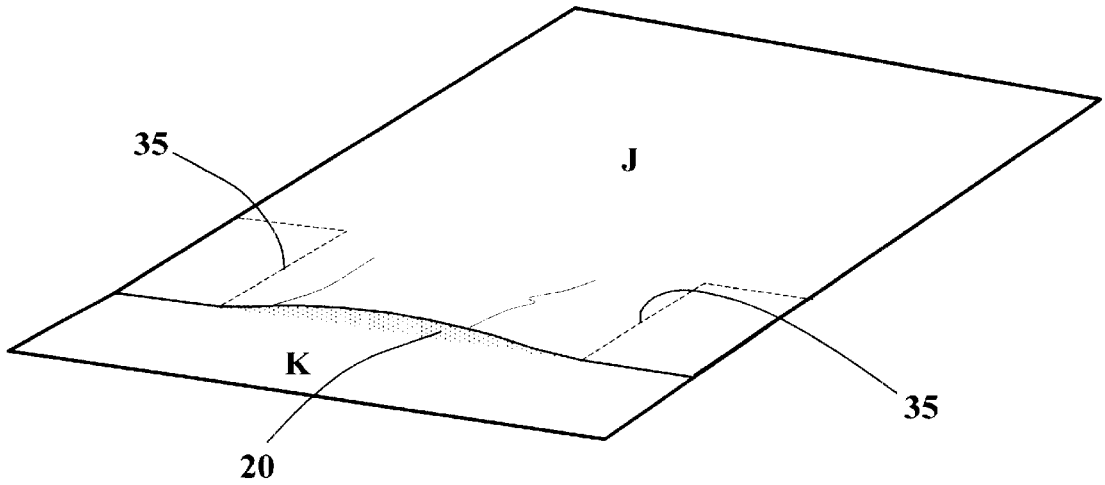
FIG. 5A shows the finished blanket assembled according to FIG. 5.

An alternative easy method of assembling this blanket 10 is by simply overlapping two pieces of fabric J and K by an amount of 12 to 15 inches in length as shown in FIG. 5. The lateral edges 29 and 30 of the overlapping sections are sewn together. The desired width of the slit is formed by sewing together from both lateral edges 29 and 30, that portion 31 with portion 32 and portion 33 with portion 34 running horizontally along the width of the slit. A stitching 35 is preferably sewn laterally as shown in FIGS. 5 and 5A to segregate the slit from the non-slit sections of the blanket. As in the other methods of assembling the blanket, the bottom overlap is identified as 20 to show correlation of the alternative methods of producing the pocketlike opening which is a core feature of the invention. In all the above methods, the slit is preferably located adjacent a lower edge of the blanket and extending between lateral edges of the blanket as shown in FIG. 1.

The blanket described here may be lined with another fabric material by methods known in the art so long as the slit is maintained according to the design described above.

The method of choice for assembling the blanket is at the discretion of the manufacturer. Other ways may be used but blankets having the pocketlike slit opening as described is within the scope of this invention.

While the embodiment of the present invention has been described, it should be understood that various changes, modifications and adaptations may be made therein without departing from the spirit of the invention and the scope of the appended claims. Those skilled in the art will recognize that other and further variations of the features presented herein are possible. The scope of the present invention should be determined by the teachings disclosed herein, the appended claims and their legal equivalents.

I claim:

1. A blanket having a slit for exposing a foot while keeping the other parts of the body covered, comprising:

a fabric material having a top surface, a bottom surface and peripheral edges protected from frilling; and, a slit across the top surface of the fabric adjacent a lower edge of the blanket and extending between lateral edges of the blanket, the slit forming an opening resembling an open bottom pocket, the opening comprised of overlapping pieces of fabric materials.

2. The blanket of claim 1 wherein the overlap of the pieces of fabric material is 12 to 15 inches.

3. The blanket of claim 2 wherein the slit of the blanket has a width the same as that of a mattress sized for the blanket.

4. The blanket of claim 2 wherein the width of the slit is at least 15 inches.

5. The blanket of claim 2 wherein the blanket is made of one layer or multilayer of fabric materials.

6. The blanket of claim 2 wherein the blanket can be formed in different geometric shapes.

7. A method of assembling a blanket with a slit adjacent a lower edge of the blanket and extending between lateral edges of the blanket, comprising:

cutting a necessary number of fabric material to a desired dimension;

overlapping two pieces of fabric material; and, sewing together each lateral sides of the overlapping pieces of fabric material to form an open bottom pocketlike opening.

8. The method of claim 7 further comprising sewing matching pieces of fabric material on each lateral side of the blanket.

9. The method of claim 7 further comprising sewing together horizontally across a portion of the opening to limit the width of the opening to a desired dimension.

10. The method of claim 9 wherein the width of the opening is the same as the width of the mattress sized for the blanket.

11. The method of claim 9 wherein the opening is at least 15 inches.

12. The method of claim 7 further comprising protecting all peripheral edges from frilling.

13. A method of assembling a blanket with a slit having a pair of horizontal side and a pair of lateral sides, comprising:

cutting a piece of fabric material conforming to a desired size and shape of the blanket;

cutting a slit of a desired width across a desired position on the piece of fabric material thereby forming a top lip and a bottom lip; and, sewing a piece of fabric material having a length of at least 12 inches and a width matching the width of the slit to the bottom lip to form an opening resembling an open bottom pocket.

14. The method of claim 13 wherein the length of the piece sewn to the bottom lip is no more than 15 inches.

15. The method of claim 13 further comprising protecting all peripheral edges of the blanket from frilling.

* * * * *